US008905796B2

(12) United States Patent
Liu

(10) Patent No.: US 8,905,796 B2
(45) Date of Patent: Dec. 9, 2014

(54) POWER SUPPLY PLUG STRUCTURE

(71) Applicant: Zhi-Hua Liu, Shenzhen (CN)

(72) Inventor: Zhi-Hua Liu, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 82 days.

(21) Appl. No.: 13/632,299

(22) Filed: Oct. 1, 2012

(65) Prior Publication Data

US 2013/0171883 A1 Jul. 4, 2013

(30) Foreign Application Priority Data

Dec. 28, 2011 (CN) ..... 2011 1 0447066

(51) Int. Cl.
*H01R 13/428* (2006.01)
*H01R 24/66* (2011.01)
*H01R 13/434* (2006.01)

(52) U.S. Cl.
CPC ..... *H01R 13/434* (2013.01); *H01R 24/66* (2013.01)
USPC ..... 439/744

(58) Field of Classification Search
CPC ..... H01R 13/434; H01R 24/66
USPC ..... 439/729, 744
See application file for complete search history.

(56) References Cited

U.S. PATENT DOCUMENTS

| | | | | |
|---|---|---|---|---|
| 3,714,617 | A * | 1/1973 | Bright et al. | 439/681 |
| 5,194,010 | A * | 3/1993 | Dambach et al. | 439/79 |
| 5,530,205 | A * | 6/1996 | Parks et al. | 174/99 B |
| 6,705,875 | B2 * | 3/2004 | Berghorn et al. | 439/63 |
| 7,097,516 | B2 * | 8/2006 | Werner et al. | 439/709 |
| 7,438,589 | B1 * | 10/2008 | Fleury et al. | 439/490 |
| 8,491,332 | B1 * | 7/2013 | Mo et al. | 439/568 |
| 2013/0171883 | A1 * | 7/2013 | Liu | 439/660 |
| 2013/0288543 | A1 * | 10/2013 | Higuchi et al. | 439/744 |
| 2014/0030932 | A1 * | 1/2014 | Lee | 439/693 |

FOREIGN PATENT DOCUMENTS

| | | |
|---|---|---|
| CN | 201365041 Y | 12/2009 |
| TW | 200828700 | 7/2008 |

* cited by examiner

*Primary Examiner* — James Harvey
(74) *Attorney, Agent, or Firm* — Novak Druce Connolly Bove + Quigg LLP

(57) ABSTRACT

A power supply plug structure includes a hollow housing, at least two conductive poles, at least two wire connecting members and at least two snap rings. The housing includes a base body. The base body defines an opening. The conductive pole includes a main body and an insertion body connected with the main body. The main body passes through the base body, and is exposed out of the housing. The insertion body is received in the housing. The wire connecting members sleeve on the conductive poles and are positioned outside of the housing. The snap ring sleeves on the main body as the main body is exposed out of the housing and also clamps the main body to hold each conductive pole on the housing.

14 Claims, 4 Drawing Sheets

POWER SUPPLY PLUG STRUCTURE

BACKGROUND

1. Technical Field

The present disclosure generally relates to plug structures, and particularly, to a power supply plug structure.

2. Description of the Related Art

Plugs and chargers and other such electrical charging items have power supply plug structures. A power supply plug structure usually includes a housing, two conductive poles and two connecting wires. The housing is a hollow structure and defines an opening. In a power supply plug structure manufacturing process, two connecting holes are firstly defined through the housing. Then the conductive poles pass through the connecting holes, and are exposed out of the housing. Next, the conductive poles are fixed to the base body by hot melt or similar process. Finally, the connecting wires are fixedly connected with part of the conductive poles which are positioned outside of the housing by soldering. However, the power supply plug structure forms a singular integrated unit after the hot melt and the soldering processes. It is inconvenient to disassemble the housing, the conductive poles and the connecting wires when the power supply plug structure is damaged and needs to be fixed.

Therefore, there is room for improvement within the art.

BRIEF DESCRIPTION OF THE DRAWING

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
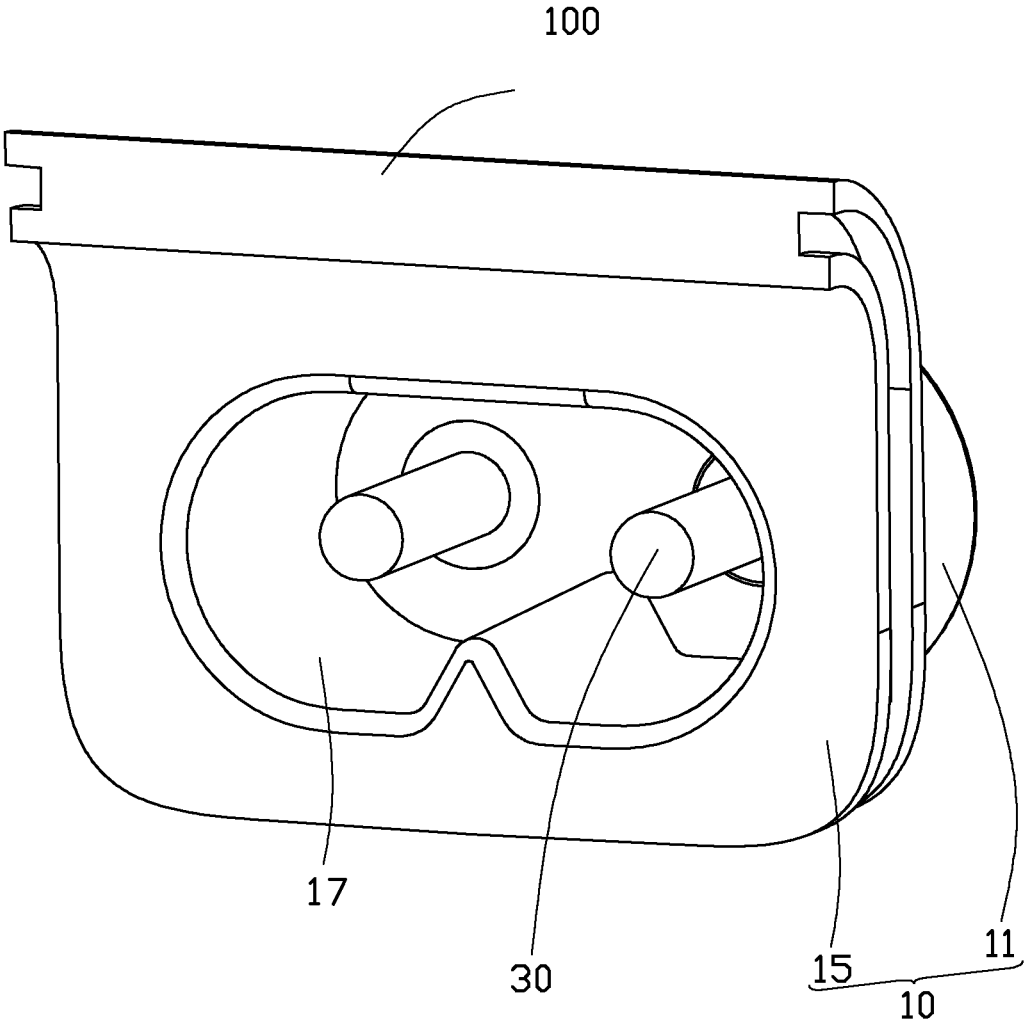
FIG. 1 is an isometric view of an embodiment of a power supply plug structure.
Figure 2:
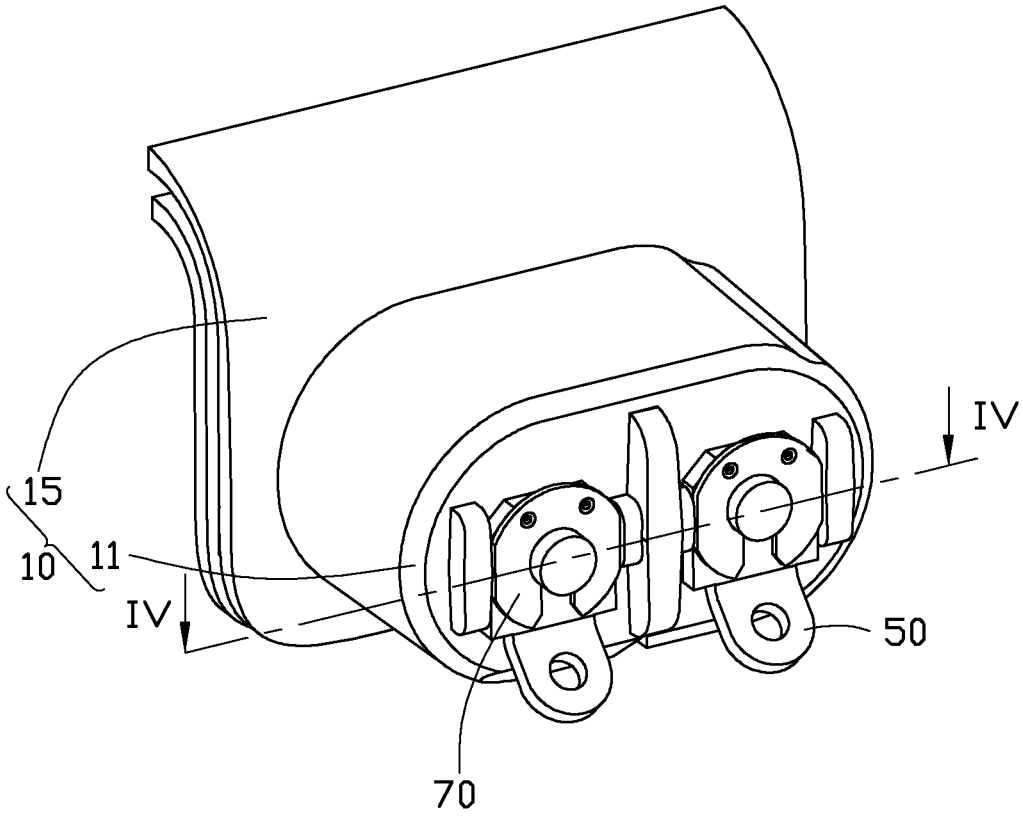
FIG. 2 is similar to FIG. 1, but viewed from another aspect.

Referring to FIGS. 1 and 2, an embodiment of a power supply plug structure 100 used in a charger is shown. The power supply plug structure 100 includes a housing 10, two conductive poles 30 and two wire connecting members 50, and two snap rings 70 or cir-clips. The two conductive poles 30 are detachably and individually positioned in the housing 10 and portions of the two conductive poles 30 are exposed out of the housing 10. The wire connecting members 50 sleeve on the conductive poles 30 out of the housing 10. Each snap ring 70 is clipped onto one conductive pole 30, and positioned adjacent to the wire connecting member 50 away from the housing 10 for fixing both the conductive pole 30 and the wire connecting member 50 to the housing 10.

Figure 3:
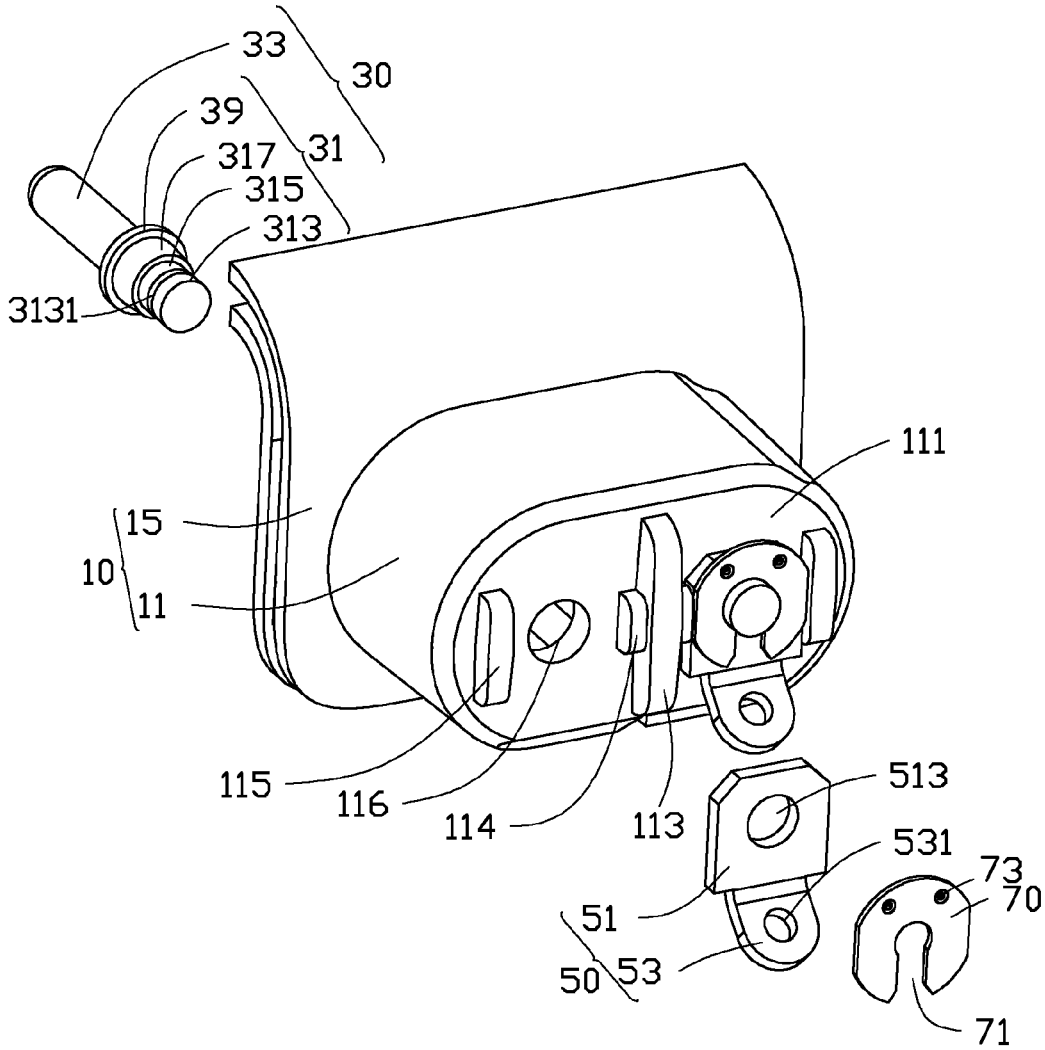
FIG. 3 is an exploded, isometric view of power supply plug structure of FIG. 2.
Figure 4:
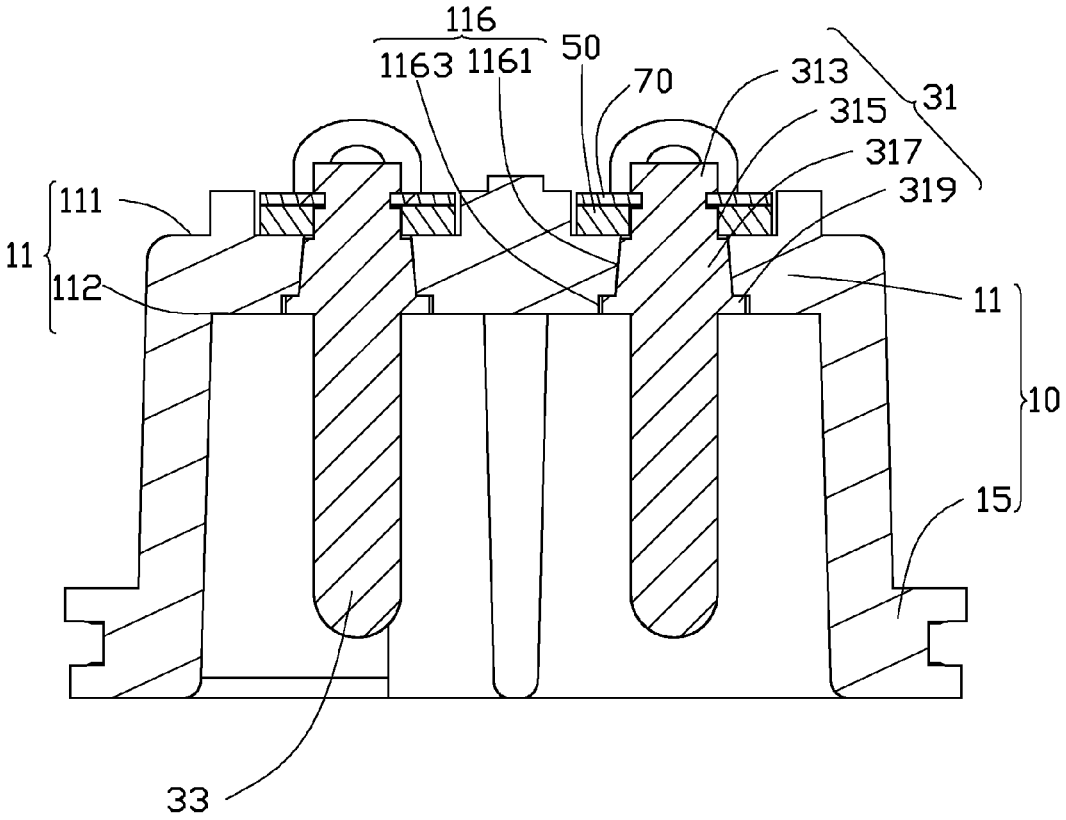
FIG. 4 shows a cross-sectional view of the FIG. 2 along the direction of IV-IV.

Also referring to FIGS. 3 and 4, the housing 10 is made of insulating materials, such as plastic. The housing 10 includes a base body 11 and an extending portion 15 extending outwardly from an end of the base body 11. The base body 11 is substantially a hollow cylindrical structure which defines an opening 17. The base body 11 includes an outer end surface 111, and an inner surface 112 opposite to the outer end surface 111. The extending portion 15 forms a frame for the base body 11, such that the base body 11 and the extending portion 15 cooperatively define the opening 17. Two stepped connecting holes 116 are defined at a distance from each other through the outer end surface 111 and the inner surface 112. Each stepped connecting hole 116 includes a positioning part 1161 and a mounting part 1163 communicating with the positioning part 1161. The positioning part 1161 is substantially a tapered hole located adjacent to the outer end surface 111. The positioning part 1161 has an increasing hole diameter going from the outer end surface 111 to the inner surface 112. The mounting part 1163 is substantially a cylindrical hole adjacent to the inner surface 112. A diameter of the mounting part 1163 is greater than that of the positioning part 1161.

The base body 11 further includes a partition block 113, two first resisting blocks 114, and two second resisting blocks 115. The first and second resisting blocks 114 and 115 function as rails or guides for the snap rings 70. The partition block 113 is substantially a barrier strip, which protrudes out from the outer end surface 111 between the two stepped connecting holes 116. The first resisting blocks 114 are positioned on the outer end surface 111. Each first resisting block 114 is positioned in between one connecting hole 116 and the partition block 113. Two second resisting blocks 115 are further formed on opposite ends of the outer end surface 111. Each stepped connecting hole 116 is also positioned between one first resisting block 114 and one second resisting block 115.

Each conductive pole 30 passes through one connecting hole 116 and extends into the opening 17 of the housing 10. The conductive poles 30 are made of conductive metal. Each conductive pole 30 is substantially cylindrical, and includes a main body 31 and an insertion body 33 connecting with the main body 31. The main body 31 includes a clamping portion 313, a contacting portion 315, a guiding portion 317 and a loading portion 319 connected in that order. The clamping portion 313, the contacting portion 315, the guiding portion 317 and the loading portion 319 of the main body 31 are coaxial with the insertion body 33.

The clamping portion 313 is positioned at one end of the main body 31 away from the insertion body 33. An annular clamping groove 3131 is formed on the clamping portion 313 adjacent to the contacting portion 315 to receive one snap ring 70. The contacting portion 315 is substantially cylindrical, and is located between the clamping portion 313 and the guiding portion 317. The guiding portion 317 is received in the positioning part 1161 of the connecting hole 116. The guiding portion 317 is substantially conical in cross-section, to correspond to the shape of the positioning part 1161, but with a smaller axial length than that of the positioning part 1161 to avoid the wire connecting member 50 from standing proud of the outer end surface 111. A diameter of the guiding portion 317 is increased going from an end of the guiding portion 317 adjacent to the contacting portion 315 to the other end of the guiding portion 317 adjacent to the loading portion 319. The loading portion 319 is located adjacent to the insertion body 33, and received in the mounting part 1163 of the connecting hole 116. The loading portion 319 is substantially a cylinder corresponding to the shape of the mounting part 1163. The insertion body 33 is connected with one end of the loading portion 319 away from the guiding portion 317 for insertion into a power socket (not shown) or for connecting with another plug to supply power.

Each wire connecting member 50 sleeves on a contacting portion 315 for electrically connecting a wire (not shown) to the conductive pole 30. The wire connecting member 50 is a shaped conductive metal piece, and includes a fixing portion 51 and a wire connecting portion 53 connecting with the fixing portion 51. The fixing portion 51 is substantially flat. A penetrating hole 513 is defined through a center of the fixing portion 51. The fixing portion 51 sleeves on the contacting portion 315 via the penetrating hole 513, and is positioned between the first resisting block 114 and second resisting block 115. A bottom surface (not labeled) of the fixing portion 51 abuts against the outer end surface 111. The wire connecting portion 53 extends upward from one end of the fixing portion 51. A wiring hole 531 is formed at a center of the wire connecting portion 53 for insertion of the wire.

Each snap ring 70 sleeves on the clamping portion 313 above the fixing portion 51, and is engaged in the clamping groove 3131. The open portion of the snap ring 70 is a clamping opening 71 for the snap ring 70. The snap ring 70 engages in the clamping groove 3131 via a slight and resilient deformation of the clamping opening 71. Two projections 73 are formed on a surface of the snap ring 70 facing towards the outer end surface 111 and distanced from the clamping opening 71. The projections 73 eliminate loose spacing in between the fixing portion 51 and the snap ring 70, and the snap ring 70 is thus held firmly in place after assembly thereof. In other embodiment, the number of the projections 73 is not limited to just two; it may be three or more.

In assembly, the main bodies 31 of the conductive poles 30 are inserted into the connecting holes 116 from the opening 17, and the insertion bodies 33 are received in the housing 10. The loading portion 319 is received in the mounting part 1163, and the guiding portion 317 is received in the positioning part 1161. The contacting portion 315 and the clamping portion 313 are exposed out of the housing 10. The wire connecting members 50 are sleeved on the contacting portions 315. Each snap ring 70 sleeves on a clamping portion 313 and engages with the clamping groove 3131. Two wires are finally connected to the wire connecting portions 53.

In use, the power supply plug 100 is inserted into a power socket (not shown), and then the wire connecting member 50 is electrically connected to the conductive pole 30.

The conductive poles 30 and the wire connecting members 50 are detachably positioned on the housing 10 via the snap rings 70. The conductive poles 30, the wire connecting members 50 and the housing 10 can be used again even after damage is done to the power supply plug structure 100 or one of its components. The usage ratio of the various components of the power supply plug structure 100 is improved. Appearance of the power supply plug structure 100 will not be affected because neither a soldering nor hot melt process is being carried out on the power supply plug structure 100. In addition, the structure and the shape of the guiding portion 317 correspond to that of the positioning part 1161, thus the guiding portion 317 will engage in the positioning part 1161 fittingly. There are no spaces found between the conductive poles 30 and the housing 10. This ensures that the conductive pole 30 is perpendicularly connected with the inner surface 112 of the base body 11. A yield ratio of the power supply plug structure product is thereby improved. Furthermore, the axial length of the guiding portion 317 is less than the axial length of the positioning part 1161 to ensure that the wire connecting member 50 is virtually flush.

In other embodiments, the number of the conductive poles 30 may be three, and the number of the wire connecting members 50 and the snap rings 70 will be changed correspondingly.

In other embodiments, the positioning part 1161 can be omitted, then the guiding portion 317 can be omitted; or the mounting part 1163 can be omitted, and then the loading portion 319 can be omitted.

In other embodiments, the partition block 113, the two first resisting blocks 114 and the two second resisting blocks 115 can be omitted.

In other embodiments, the snap ring 70 may be designed to be a full ring, without any circumferential opening, and then the snap ring 70 can be clamped by the clamping portion 313 directly.

In other embodiments, the extending portion 15 of the housing 10 can be omitted.

While the present disclosure has been described with reference to particular embodiments, the description is illustrative of the disclosure and is not to be construed as limiting the disclosure. Therefore, various modifications can be made to the embodiments by those of ordinary skill in the art without departing from the true spirit and scope of the disclosure, as defined by the appended claims.

What is claimed is:

1. A power supply plug structure, comprising:

a housing being a hollow structure and comprising a base body defining an opening;

at least two conductive poles, each conductive pole comprising a main body and an insertion body connected with the main body, the main body passing through the base body and exposed out of the housing, the insertion body received in the base body;

at least two wire connecting members, each wire connecting member sleeving on one conductive pole and positioned outside of the housing; and at least two snap rings, each snap ring sleeving on the main body exposed out of the housing and clamped by the main body of one conductive pole to hold the conductive pole on the housing, wherein each snap ring comprises at least one projection, the at least one projection is protruded from one surface of the snap ring toward the housing for eliminating spaces between the snap ring and the wire connecting member.

2. The power supply plug structure of claim 1, wherein each snap ring comprises a clamping opening, the snap ring is clipped onto the main body via the clamping opening.

3. A power supply plug structure, comprising:

a housing comprising a base body defining an opening, wherein the base body comprises an outer end surface, an inner surface, two first resisting blocks, and two second resisting blocks, the outer end surface is positioned outside of the housing away from the opening end, two first resisting blocks are positioned on the outer end surface between the at least two conductive poles, the two second resisting blocks are positioned on the opposite ends of the outer end surface, each conductive pole is between one first resisting block and one second resisting block;

at least two conductive poles, each conductive pole comprising a main body and an insertion body connected with the main body, the main body passing through the base body and exposed out of the housing, the insertion body received in the base body;

at least two wire connecting members, each wire connecting member sleeving on one conductive pole and positioned outside of the housing; and at least two snap rings, each snap ring sleeving on the main body exposed out of the housing and clamped by the main body of one conductive pole to hold the conductive pole on the housing.

4. The power supply plug structure of claim 1, wherein each main body comprises a clamping groove, the clamping groove is defined on a part of the main body which is positioned outside of the housing, and each snap ring is engaged in one clamping groove.

5. The power supply plug structure of claim 4, wherein the housing comprises at least two connecting holes, each connecting hole comprises a positioning part, the main body comprises a clamping portion, a contacting portion and a guiding portion connected in that order, the clamping groove is formed on the clamping portion, each wire connecting member sleeves on one contacting portion, the guiding portion is received in the positioning part.

6. The power supply plug structure of claim 5, wherein the positioning part is a tapered hole, and the guiding portion is a conic in cross-section corresponding to the shape of the positioning part.

7. The power supply plug structure of claim 6, wherein the base body comprises an outer end surface and an inner surface, a hole diameter of the positioning part is increased along a direction from the outer end surface to the inner surface of the base body, and the diameter of the guiding portion is increased from an end of the guiding portion adjacent to the contacting portion to another end of the guiding portion adjacent to the loading portion.

8. The power supply plug structure of claim 5, wherein each connecting hole further comprises a mounting part, the main body further comprises a loading portion positioned between the guiding portion and the insertion body, the loading portion is received in the mounting part.

9. The power supply plug structure of claim 8, wherein the mounting part is a circular hole, the loading portion is cylindrical in shape corresponding to the shape of the mounting part.

10. The power supply plug structure of claim 9, wherein the diameter of the mounting part is greater than the diameter of the positioning part, the diameter of the loading portion corresponding to the diameter of the mounting part is greater than the diameter of the guiding portion.

11. The power supply plug structure of claim 1, wherein the base body comprises an outer end surface, an inner surface, two first resisting blocks, and two second resisting blocks, the outer end surface is positioned outside of the housing away from the opening end, two first resisting blocks are positioned on the outer end surface between the at least two conductive poles, the two second resisting blocks are positioned on the opposite ends of the outer end surface, each conductive pole is between one first resisting block and one second resisting block.

12. The power supply plug structure of claim 11, wherein two side surfaces of the snap ring resist against the corresponding first resisting block and the second resisting block.

13. The power supply plug structure of claim 1, wherein the housing further comprises an extending portion, the extending portion extends from edges of the opening.

14. A power supply plug structure, comprising:

a housing comprising a base body defining an opening and at least two connecting holes communicating with the opening, wherein each of the at least two connecting holes comprising a positioning part with a hole diameter gradually decreased from an end of the positioning part adjacent to the opening;

at least two conductive poles, each conductive pole comprising a main body and an insertion body connected with the main body, the main body passing through the base body and exposed out of the housing, the insertion body received in the base body, wherein the main body forms a guiding portion received in the positioning part, the guiding portion has a diameter gradually decreased from an end of the guiding portion adjacent to the opening;

at least two wire connecting members, each wire connecting member sleeving on one conductive pole and positioned outside of the housing; and at least two snap rings, each snap ring sleeving on the main body exposed out of the housing and clamped by the main body of one conductive pole to hold the conductive pole on the housing.

* * * * *